US005361585A

United States Patent [19]

Westphal et al.

[11] Patent Number: 5,361,585

[45] Date of Patent: Nov. 8, 1994

[54] STEAM TURBINE SPLIT FORWARD FLOW

[75] Inventors: Bernd A. K. Westphal, Clifton Park, N.Y.; Thane M. Drummond, Roanoke, Va.

[73] Assignee: General Electric Company, Schenectady, N.Y.

[21] Appl. No.: 81,200

[22] Filed: Jun. 25, 1993

[51] Int. Cl.[5] ..... F01K 13/02

[52] U.S. Cl. ..... 60/646; 60/656; 60/679

[58] Field of Search ..... 60/646, 656, 679

[56] References Cited

U.S. PATENT DOCUMENTS

| | | | |
|---|---|---|---|
| 3,097,488 | 7/1963 | Eggensberger et al. | 415/15 |
| 3,340,883 | 9/1967 | Peternel | 415/15 |
| 3,879,616 | 4/1975 | Baker et al. | 290/40 R |
| 4,120,159 | 10/1978 | Matsumoto et al. | 60/667 |
| 4,132,076 | 1/1979 | Weiss | 60/646 |
| 4,178,762 | 12/1979 | Binstock et al. | 60/667 |
| 4,258,424 | 3/1981 | Giras et al. | 364/494 |
| 4,316,362 | 2/1982 | Ninomaya et al. | 60/646 |
| 4,386,498 | 6/1983 | Lee et al. | 60/646 |
| 4,408,458 | 10/1983 | Torii | 60/660 |
| 4,461,152 | 7/1984 | Tennichi et al. | 60/660 |
| 4,658,590 | 4/1987 | Higashi et al. | 60/660 |
| 4,665,706 | 5/1987 | Russell et al. | 60/646 |
| 4,744,723 | 5/1988 | Hashimoto et al. | 60/646 |
| 4,748,814 | 6/1988 | Tanji et al. | 60/664 |
| 4,793,132 | 12/1988 | Okabe | 60/39.182 |
| 4,853,552 | 8/1989 | Kure-Jensen et al. | 290/40 C |
| 4,873,827 | 10/1989 | Hadano et al. | 60/646 |

*Primary Examiner*—Ira S. Lazarus
*Assistant Examiner*—L. Heyman
*Attorney, Agent, or Firm*—Nixon & Vanderhye

[57] ABSTRACT

In a steam turbine system including a high pressure turbine section, a reheat turbine section and a low pressure turbine section coupled to a generator, and wherein a boiler supplies steam to the high pressure turbine and wherein a condenser is arranged to receive spent steam from the low pressure turbine and to return the spent steam to the boiler, a process including the steps of: a) during cold start-up, bypassing a portion of the steam generated by the boiler around the high pressure turbine section, reheat turbine section and low pressure turbine section and feeding the bypass portion directly to the condenser, accelerating the turbine to a predetermined speed less than approximately 1000 rpm utilizing control valves at an inlet side of the high pressure turbine section while keeping closed a plurality of intercept valves at an inlet side of the reheat turbine section; and wherein steam pressure to the high pressure turbine section is controlled by a high pressure bypass valve; and b) upon reaching said predetermined speed, fixing the control valves at a learned value corresponding substantially to a valve opening required to reach the predetermined speed; and c) opening the reheat stop valves and and using the intercept valves alone to control turbine speed until a predetermined synchronization speed is reached.

9 Claims, 2 Drawing Sheets

STEAM TURBINE SPLIT FORWARD FLOW

TECHNICAL FIELD

The present invention relates generally to large steam turbine/generator systems which include a high pressure (HP) turbine section, a reheat or intermediate pressure (IP) turbine section, a low pressure (LP) turbine section and a generator and other related components such as a boiler, a reheater and related valves. The invention more specifically relates to a process for cold starting such a turbine in a manner which avoids erosion of the high pressure turbine and/or overheating of the low pressure turbine due to flow starvation.

BACKGROUND

A boiler is sometimes provided for a large steam turbine which can only be started with a turbine bypass system. When starting a cold turbine, however, the turbine is required to be rolled after insufficient time for warming of the rotors on turning gear. Low pressure turbine bypass valves control reheat steam pressure to the reheat turbine. If the turbine is rolled with a cold HP rotor, however, water will condense and accumulate in the HP rotor, possibly leading to erosion of the HP buckets at speeds greater than approximately 1000 rpm, if insufficient flow through the HP turbine section does not blow out any freshly forming condensate. If insufficient steam flows through the low pressure turbine section, overheating of the last stages of the LP turbine section will occur at higher speed.

A problem exists in that with the reheat pressure controlled by the low pressure bypass valves, two sets of controlling turbine valves must be used to control a single turbine speed, i.e., stop/control valves controlling steam to the HP turbine section, and reheat stop/intercept valves controlling steam to the reheat or IP turbine section as well as the LP turbine section. It is normal that slight miscalibration of the controlling valves will exist, which can lead to either starving of flow in the HP turbine section or LP turbine section, resulting in erosion in the HP turbine section and/or overheating in the LP turbine section.

SUMMARY OF THE INVENTION

It is the principal object of this invention to accelerate a cold steam turbine from turning gear to full synchronization with the control valves and intercept valves without erosion in the HP turbine section or overheating of the LP turbine section. Thus, in accordance with the first exemplary embodiment of the invention, the turbine generator will be accelerated to a speed less than about 1000 rpm solely with the control valves of the HP turbine section. The reheat stop and intercept valves are closed and the reheat (or IP) and LP turbine sections are bypassed via the LP turbine bypass valves. Once the desired speed (less than approximately 1000 rpm) is reached, the reheat stop valves are opened and the intercept valves alone are used for speed control to rated speed, with the HP control valves fixed as explained below.

In its broader aspects, therefore, the present invention relates to a steam turbine system comprising a high pressure turbine section, a reheat turbine section and a low pressure turbine section coupled to a generator, and wherein a boiler supplies steam to the high pressure turbine section and wherein a condenser is arranged to receive spent steam from the low pressure turbine section and to return the spent steam to the boiler, the process comprising the steps of:

a) during cold start-up, bypassing a portion of the steam generated by the boiler around the high pressure turbine section, reheat turbine section and low pressure turbine section and feeding the bypass portion directly to the condenser, and accelerating the turbine to a predetermined speed less than approximately 1000 rpm utilizing control valves at an inlet side of the high pressure turbine section while keeping closed a plurality of stop valves and associated intercept valves at an inlet side of the reheat turbine section;

b) upon reaching the predetermined speed, fixing the control valves at a learned value corresponding substantially to a valve opening required to reach the predetermined speed; and c) opening said stop valves at the inlet side of the reheat turbine section and using the intercept valves alone to control turbine speed until a predetermined synchronization speed is reached.

In another aspect, the invention relates to a process for accelerating a turbine-generator from start-up to synchronization, the turbine generator including a high pressure turbine section, a reheat turbine section, and a low pressure turbine section operatively connected to a generator; a boiler for supplying steam to the high pressure section; and a reheater connected between the high pressure turbine section and the reheat turbine section; and wherein the boiler supplies steam through a first conduit to the high pressure turbine section, steam from the high pressure turbine section passes through a second conduit to a reheater and is returned to the reheat turbine through a third conduit from which steam is fed to the low pressure turbine section through a fourth conduit and then to a condenser; and wherein a high pressure bypass control valve is arranged in a fifth conduit extending between said first and second conduits, and a low pressure bypass control valve as arranged in a sixth conduit extending between said third conduit and the condenser; and wherein a stop valve and a control valve are located in said first conduit downstream of the fifth conduit and upstream of the high pressure turbine section; and wherein an intercept valve and a reheat stop valve are located in the third conduit between the reheater and the reheat turbine section; the process comprising the steps of:

a) with the reheat turbine section intercept valve and reheat stop valve closed, accelerating the turbine with the high pressure turbine section control valve until a minimum speed of approximately 500 rpm is reached;

b) fixing the flow demand to the high pressure turbine section control valve to maintain said minimum speed;

c) opening the reheat turbine section stop valve and utilizing the reheat turbine section intercept valve alone for controlling speed of the turbine to the rated speed.

BEST MODE FOR CARRYING OUT THE INVENTION

Figure 1:
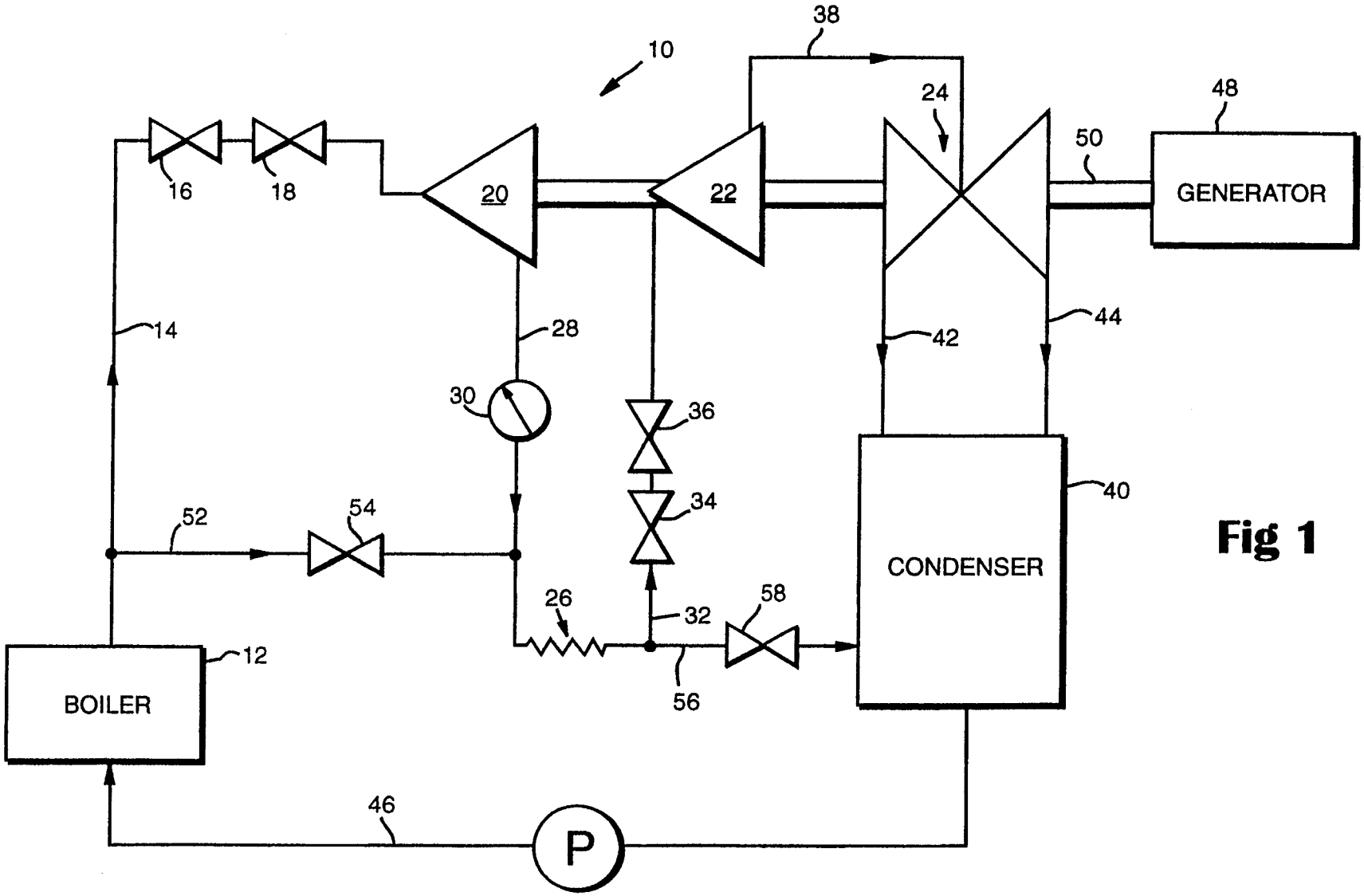
FIG. 1 is a valve diagram of a turbine-generator system in accordance with this invention.

The turbine 10 is composed of a high pressure turbine section 20, an intermediate pressure or reheat turbine section 22 and a low pressure turbine section 24. A boiler 12 is provided for supplying steam to the high pressure section 20 of the turbine 10 through line 14 and main stop valves 16 and control valves 18. Typically, two stop valves are provided in parallel and four control valves are provided, also in parallel. The specific configuration may vary, however, as will be appreciated by those skilled in the art. Steam from line 14 exiting the high pressure (HP) section 20 is supplied to a reheater 26 via line 28 and check valve 30 where the temperature of the steam is raised before it is fed to the intermediate pressure (IP or reheat) section 22, and low pressure (LP) section 24 via line 32 including intercept valves 34, reheat stop valves 36, and line 38. In a typical arrangement, two parallel intercept valves are paired with two parallel reheat stop valves. The steam having done work in the intermediate and low pressure sections 20 and 22, is subsequently passed to the condenser 40 via lines 42, 44, where the steam is condensed into water, and returned to the boiler 12 via pump P and line 46.

Energy carried by the steam is converted by the turbine 10 into mechanical energy for rotating an electric generator 48 via the coupling 50.

The system as shown also includes a high pressure turbine section bypass line 52 and associated HP bypass control valve 54 extending between lines 14 and 28, and a low pressure bypass line 56 and associated LP bypass control valve 58 located between the reheater 26 and the condenser 40. The HP bypass control valve 54 controls the steam pressure in line 14, while the LP bypass control valve 58 controls the reheat steam pressure in line 32.

The above described arrangement is conventional in terms of structural arrangement, but the manner in which the structure and particularly the various valves are used, is unique to this invention.

Figure 2:
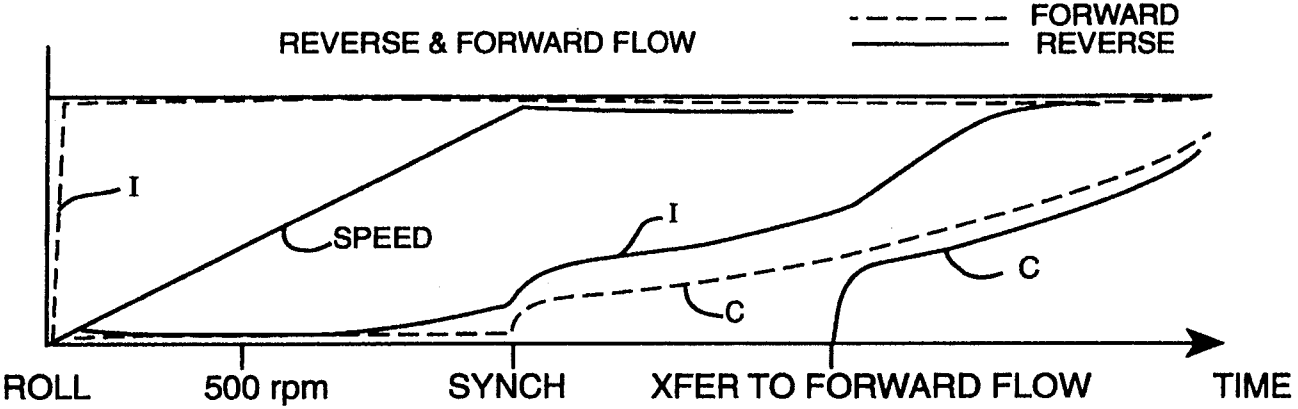
Fig 2 Prior Art
FIG. 2 is a graph for reverse and forward flow, illustrating valve movement as a function of time from start-up to a point beyond synchronization.

With reference to FIG. 2, conventional valve utilization is illustrated for both reverse and forward flow. It will be understood by those skilled in the art that by "forward flow" is meant a situation where steam flows through the high pressure section of the turbine in the forward direction only. By "reverse flow" is meant a situation where the control valves 18 are closed and steam is instead passed through the HP bypass control valve 54 and a reverse flow valve (not shown) in line 28 such that a portion of the steam flows through the high pressure section of the turbine in a reverse direction, while the remainder of the steam flows in a forward direction toward the reheat turbine section.

In a typical forward flow arrangement, and with reference also to FIG. 2, the reheat stop valves 36 and intercept valves I (34) are fully opened at start-up, and remain open through the start-up procedure and during operation at rated speed. The control valves C (18) are utilized to control acceleration through start-up and beyond synchronization.

In a reverse flow configuration, the control valves 18 are closed throughout the start-up process and beyond synchronization, and are not opened until transfer to forward flow. The intercept valves 34 are utilized from start-up through synchronization and transfer to forward flow until 100% opening is achieved after transfer to forward flow.

Figure 3:
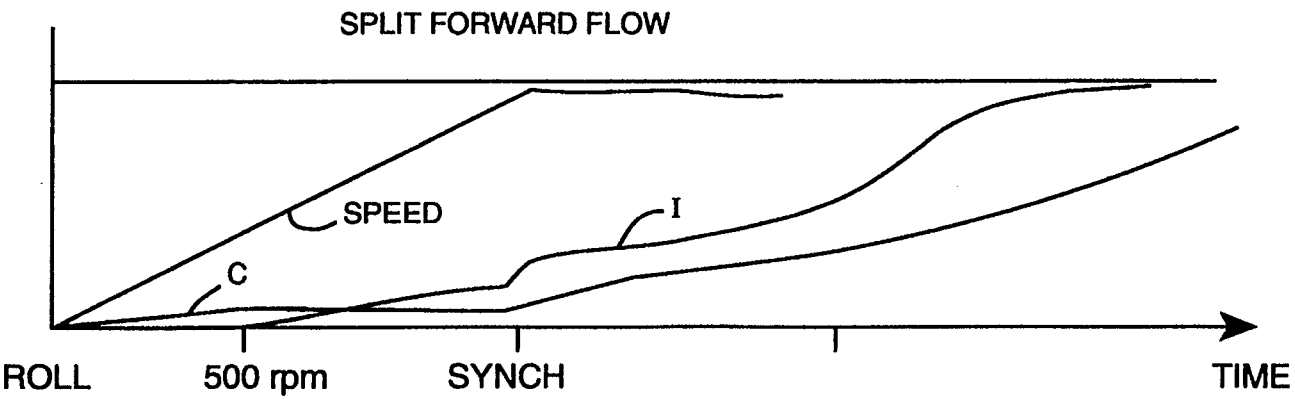
FIG. 3 is a graph for split forward flow in accordance with the invention, illustrating valve opening as a function of time from start-up to a point beyond full synchronization.

Turning now to FIG. 3, the manner in which the valves are utilized in accordance with this invention is illustrated. During start-up, most of the steam is bypassed around the HP turbine section 20 via bypass 52, with small amounts of steam introduced in the HP turbine section 20. In this arrangement, the reheat stop valves 36 and intercept valves I (34) remain closed while the control valves C (18) are utilized to accelerate the turbine preferably to a speed of approximately 500 rpm. During this time, the intercept valves 34 are closed with a bias of −10%. At approximately 500 rpm, the flow demand to the control valves 18 is fixed at a learned value, i.e., the control valves are frozen at the controlled value necessary to maintain the approximate 500 rpm speed, but also taking into account the turbine performance characteristics, valve calibration and the like. The valves are fixed for the period of time during which the speed increases from approximately 500 rpm to the synchronization speed at approximately 3600 rpm. At approximately 500 rpm, the reheat stop valves 36 are opened and the closing bias to the intercept valve is removed. Thereafter, the intercept valves 34 are used for speed control through synchronization and beyond the transfer to forward flow. Once the rated speed has been reached, the control valve bias will be removed at full synchronization and normal speed/load control will be employed. With the above described process, a cold large steam turbine may be accelerated from turning gear to synchronization without erosion in the high pressure turbine section or overheating in the low pressure turbine section.

While the invention has been described with respect to what is presently regarded as the most practical embodiments thereof, it will be understood by those of ordinary skill in the art that various alterations and modifications may be made which nevertheless remain within the scope of the invention as defined by the claims which follow.

What is claimed is:

1. In a steam turbine system comprising a high pressure turbine section, a reheat turbine section and a low pressure turbine section coupled to a generator, and wherein a boiler supplies steam to the high pressure turbine section and wherein a condenser is arranged to receive spent steam from the low pressure turbine section and to return the spent steam to the boiler, the process comprising the steps of:

a) during cold start-up, bypassing a portion of the steam generated by the boiler around the high pressure turbine section, reheat turbine section and low pressure turbine section and feeding the bypass portion directly to the condenser, and accelerating the turbine to a predetermined speed less than approximately 1000 rpm utilizing control valves at an inlet side of the high pressure turbine section while keeping closed a plurality of stop valves and associated intercept valves at an inlet side of the reheat turbine section; and b) upon reaching said predetermined speed, fixing said control valves at a learned value corresponding substantially to a valve opening required to reach said predetermined speed; and c) opening said stop valves at the inlet side of said reheat turbine and using said intercept valves alone to control turbine speed until a predetermined synchronization speed is reached.

2. The process of claim 1 wherein said predetermined speed less than approximately 1000 rpm comprises approximately 500 rpm.

3. The process of claim 1 wherein, during step a) steam pressure to the high pressure turbine section is controlled by a high pressure bypass valve.

4. The process of claim 1 wherein, after synchronization, said control valves are released from the learned value.

5. A process for accelerating turbine-generator from start-up to synchronization, the turbine generator including a high pressure turbine section, a reheat turbine section, and a low pressure turbine section operatively connected to a generator; a boiler for supplying steam to the high pressure turbine section; and a reheater connected between the high pressure turbine and the reheat turbine section; and wherein the boiler supplies steam through a first conduit to the high pressure turbine section, steam from the high pressure turbine section passes through a second conduit to a reheater and is returned to the reheat turbine section through a third conduit from which steam is fed to the low pressure turbine section through a fourth conduit and then to a condenser; and wherein a high pressure bypass control valve is arranged in a fifth conduit extending between said first and second conduits, and a low pressure bypass control valve as arranged in a sixth conduit extending between said third conduit and the condenser; and wherein a stop valve and a control valve are located in said first conduit downstream of said fifth conduit and upstream of said high pressure turbine; and wherein an intercept valve and a reheat stop valve are located in the third conduit between the reheater and the reheat turbine; the process comprising the steps of:

a) with the intercept valve and reheat stop valve closed, accelerating the turbine with the control valve until a minimum speed of approximately 500 rpm is reached;

b) fixing the flow demand to the control valve to maintain said minimum speed;

c) opening the reheat stop valve and utilizing the intercept valve alone for controlling speed to synchronization at rated speed.

6. The process of claim 5 wherein during step a), the reheat turbine section and the low pressure turbine section are bypassed by means of the low pressure turbine bypass valve.

7. The process of claim 5 wherein during step a), pressure in the first conduit is controlled by the high pressure bypass control valve.

8. The process of claim 5 wherein during step a), the intercept valve is closed with a bias of −10%.

9. The process of claim 5 wherein during step b), flow demand also takes into account the performance characteristics of the turbine and valve calibration.

* * * * *